US005519480A

United States Patent [19]

Thayer et al.

[11] Patent Number: 5,519,480

[45] Date of Patent: May 21, 1996

[54] RETRACTION OF CLEANER BACKERS TO ENABLE DISENGAGEMENT OF THE CLEANER FROM THE PHOTORECEPTOR FOR IMAGE ON IMAGE, MULTI-PASS COLOR DEVELOPMENT

[75] Inventors: Bruce E. Thayer, Webster; Robert S. Pozniakas, Rochester; David E. Rollins, Lyons, all of N.Y.

[73] Assignee: Xerox Corporation, Stamford, Conn.

[21] Appl. No.: 341,735

[22] Filed: Nov. 18, 1994

[51] Int. Cl.[6] ..... G03G 21/00

[52] U.S. Cl. ..... 355/301; 15/256.5; 198/496; 355/296

[58] Field of Search ..... 355/212, 296, 355/299–301; 118/652; 15/256.5–256.53; 198/496

[56] References Cited

U.S. PATENT DOCUMENTS

| | | | |
|---|---|---|---|
| 4,230,406 | 10/1980 | Klett | 355/305 |
| 4,279,496 | 7/1981 | Silverberg | 355/212 |
| 4,499,849 | 2/1985 | Tomita et al. | 118/652 |
| 4,630,920 | 12/1986 | Silverberg et al. | 355/299 |
| 4,669,864 | 6/1987 | Shoji et al. | 355/297 |
| 4,769,671 | 9/1988 | Koff | 355/212 |
| 5,209,808 | 5/1993 | Booth | 156/487 |
| 5,243,385 | 9/1993 | Thayer | 355/212 |
| 5,291,258 | 3/1994 | Cain et al. | 355/296 |

*Primary Examiner*—William J. Royer
*Attorney, Agent, or Firm*—T. L. Fair

[57] ABSTRACT

An apparatus and method for cleaning particles from a moving imaging surface. Backers are retracted from the photoreceptor to release cleaning contact between the brushes and the moving imaging surface during development of image-on-image in the multi-pass cycle. After transfer of the image, the backers move into contact with one side of the photoreceptor causing the moving imaging surface, on the other side of the photoreceptor, to contact the cleaner brushes. The brushes clean the moving imaging surface of the photoreceptor. The brushes are released from contact with the moving imaging surface when the backers are retracted, allowing the image on image multi-pass process to begin again. The brushes engage and disengage the photoreceptor in the interdocument zone (i.e. non-imaging region) of the moving surface.

21 Claims, 4 Drawing Sheets

RETRACTION OF CLEANER BACKERS TO ENABLE DISENGAGEMENT OF THE CLEANER FROM THE PHOTORECEPTOR FOR IMAGE ON IMAGE, MULTI-PASS COLOR DEVELOPMENT

CROSS REFERENCE

Cross reference is made to and priority is claimed from U.S. patent application Ser. No. 08/342,284 entitled "Sequenced Cleaner Retraction Method and Apparatus", in the name of Robert S. Pozniakas et al., assigned to the same assignee as the present application and filed concurrently herewith.

BACKGROUND OF THE INVENTION

This invention relates generally to a cleaning apparatus, and more particularly, concerns an apparatus for disengaging the cleaner brushes from the photoreceptive surface.

In the image on image, multi-pass color development process, four layers of color toner (black, cyan, yellow and magenta) are developed onto the photoreceptor before transfer to paper. A separate cycle of the photoreceptor is required to accomplish the development of each color toner layer. To avoid disturbance of these images as the color toner layers are being developed, the cleaning elements must be disengaged from the photoreceptor surface until after the four toner layers have been developed and transferred to paper. After the toner image has been transferred to the paper the cleaning elements must be re-engaged to the photoreceptor to clean any residual toner which failed to transfer.

Several copiers presently use the multi-pass process before a single transfer step. The Konica 9028 machine uses a blade cleaner which is retracted from the photoreceptor drum while the color images are being developed. The Panasonic FP-C1 machine uses a single electrostatic brush cleaner which is retracted by a cam from the drum photoreceptor. The Sharp CX7500 machine uses an intermediate belt and a dual blade cleaner which is retracted from the photoreceptor belt by a solenoid during color image development. The primary, high load, blade is also retracted when the photoreceptor seam passes under the blade to avoid a motion quality disturbance. All of these methods involve movement of the cleaning device into and out of contact with the photoreceptor.

The following disclosure may be relevant to various aspects of the present invention and may be briefly summarized as follows:

U.S. Pat. No. 5,209,808 to Booth discloses an applicator system and method for automatically applying and securing an adhesive backed label onto a corner surface. The applicator head includes a backer plate and a tamping mechanism (or tamper plate) connected in spaced relationship through helical (or other) springs to the backer plate, whereby a label applied to the tamping mechanism is applied to the corner surface through spring force of the helical springs which press the label onto the corner surface but are sufficiently resilient to permit movement of the backer plate orthogonal to the tamper plate, and thus, relative to the corner surface.

U.S. Pat. No. 4,769,671 to Koff discloses an apparatus in which a tubular member mounted on a shaft moves linearly in response to rotation of the shaft. A cam is mounted on the shaft and in engagement with bearings mounted on the interior surface of the tubular member. As the shaft rotates, the cam moves in unison therewith to move the tubular member linearly. The linear movement of the tubular member moves a portion of a photoconductive belt between an operative position, adjacent a developer unit, and an inoperative position, spaced from the developer unit.

U.S. Pat. No. 4,669,864 to Shoji et al. discloses an image forming apparatus having a cleaning device arranged on the outer periphery of an image retainer, and bringing into and out of abutment against the image retainer, wherein the cleaning device comprises a first cleaning member and a second cleaning member arranged downstream of the first cleaning member in the moving direction of the surface of the image retainer. A cleaning operation of the second cleaning member against the image retainer is conducted according to a time at which the cleaning operation of the first cleaning member against the image retainer is conducted.

U.S. Pat. No. 4,230,406 to Klett discloses an apparatus which cleans particles from a photoconductive member arranged to advance along a predetermined path. When the photoconductive member is stationary, the particle cleaner and photoconductive member are spaced from one another. The photoconductive member is deflected into engagement with the particle cleaner in response to the photoconductive member advancing along the pre-determined path. In this manner, the particle cleaner removes residual particles from the photoconductive member during the movement thereof along the pre-determined path.

SUMMARY OF INVENTION

Briefly stated, and in accordance with one aspect of the present invention, there is provided an apparatus for removing particles from a surface after transfer of an image therefrom. The apparatus comprises a cleaning device and a non-rotating member supporting the surface. The member moving the surface between a first position remote from the cleaning device and a second position in contact with the cleaning device in response to the image having been transferred from the surface.

Pursuant to another aspect of the present invention, there is provided a method for cleaning particles from a surface, having an imaging region and a non-imaging region. The method comprises transferring a developed image from the surface; moving the non-rotating backer into contact with a side of the surface to urge the surface into contact with a cleaning device after the transferring step; enabling the cleaning device to remove particles from the surface remaining thereon, after transfer of the developed image therefrom; and spacing the backer from the surface to space the cleaning device from the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 7:
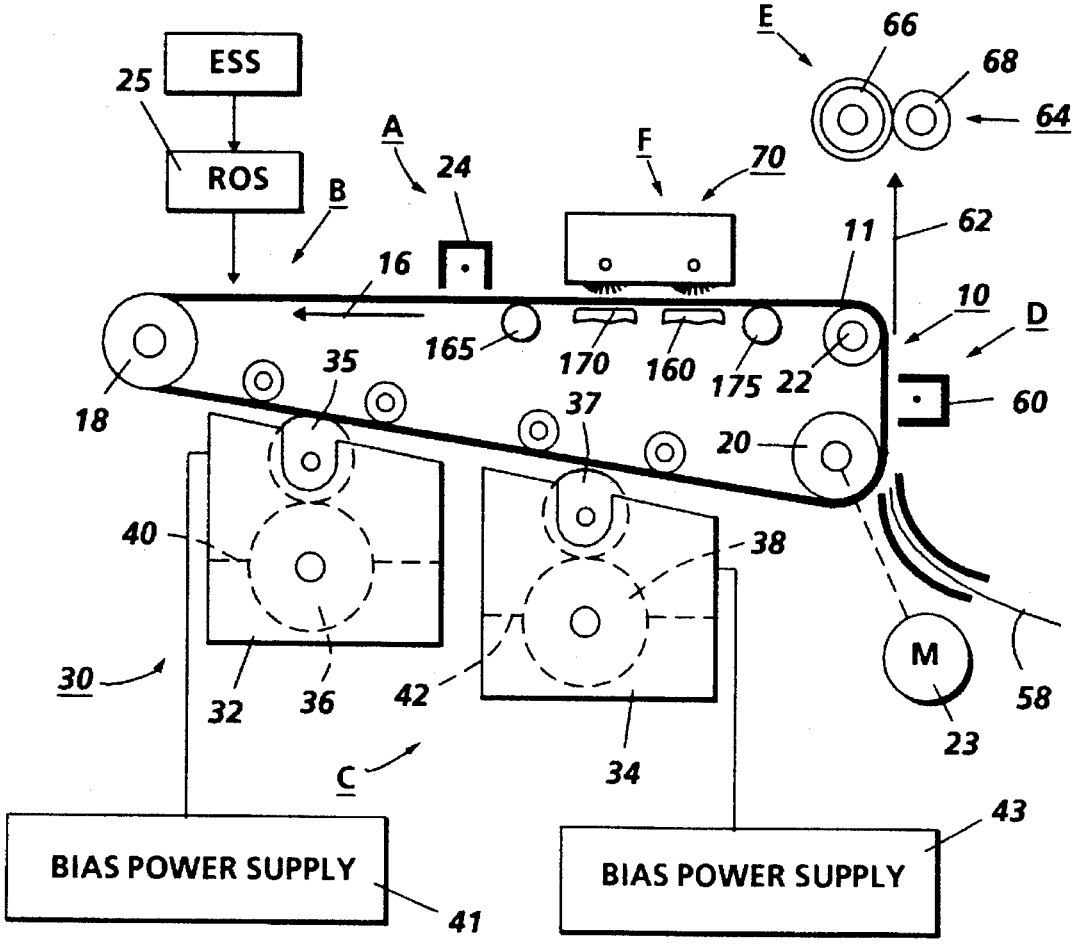
FIG. 7 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 7 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 7, initially successive portions of belt 10 pass through charging station A. At charging station A, a corona charge device such as a scorotron, corotron or dicorotron indicated generally by the reference numeral 24, charges the belt 10 to a selectively high uniform positive or negative potential. This charging has to occur for every color. Any suitable control, well known in the art, may be employed for controlling the corona charge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two-level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first and second developer apparatuses 32 and 34. (However, this number may increase depending upon the number of colors, i.e. for four colors there would be four developer housings.) The developer apparatus 32 comprises a housing containing a donor roll 35 and a magnetic roller 36. The developer apparatus 34 comprises a housing containing a donor roll 37 and a magnetic roller 38. The magnetic roller 36 develops toner onto donor roll 35. The donor roll 35 then develops the toner onto the imaging surface 11. It is noted that the development housings 32, 34 and any subsequent development housings must be scavengeless so as not to disturb the image formed by the previous housing. Both housings contain developer material 40, 42 of the selected colors. Electrical biasing is accomplished via power supply 41, electrically connected to developer apparatus 32. A D.C. bias is applied to the rollers 35 and 36 via the power supply 41. Appropriate electrical biasing is accomplished via power supply 43, electrically connected to developer apparatus 34. A D.C. bias is applied to the rollers 37 and 38 via the bias power supply 43.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by backers 160, 170. The photoreceptor belt 10 is also supported on the either side of the cleaning unit by backup rolls 165 and 175.

Figure 1:
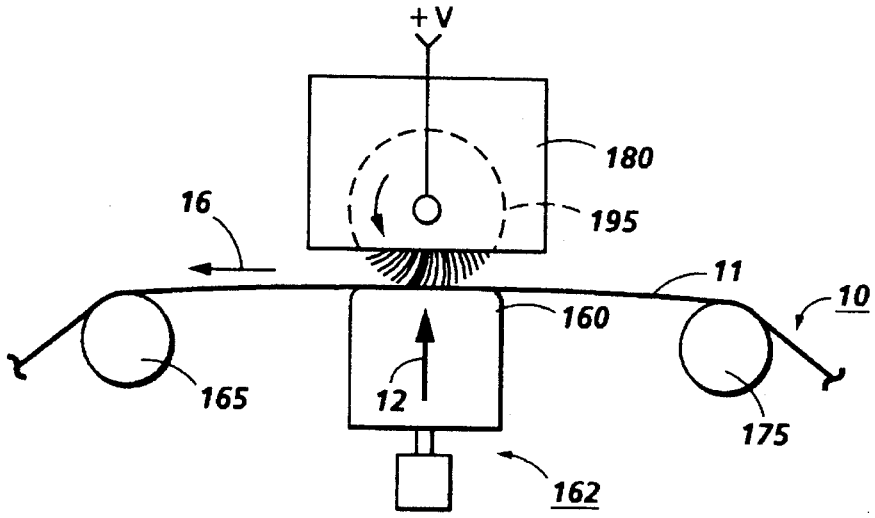
FIG. 1 is a schematic elevational view of a single brush cleaner with the backer engaged.
Figure 2:
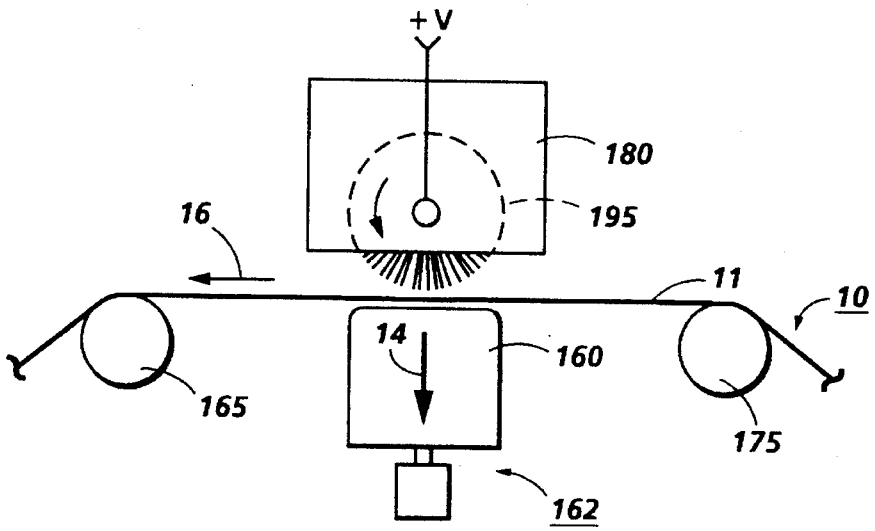
FIG. 2 is a schematic elevational view of a single brush cleaner with the backer retracted.

In the present invention, retracting the cleaner backers in the printing machine from the flexible belt photoreceptor is proposed as a method to disengage the cleaner from the photoreceptor. This method reduces the complexity of the cleaner drive because no retraction motion of the cleaner is required. The backers are solid and substantially rigid to provide support for the flexible photoreceptor belt especially when the photoreceptor and the cleaner are in contact with each other. The backers are retracted and engaged with the belt photoreceptor using a solenoid or electrical motor or another electro-mechanical device 162 (see FIGS. 1–6). This invention is shown schematically in FIGS. 1 and 2 for a single brush cleaner. The backer 160 is located on the opposite side of the photoreceptor belt 10 from the imaging surface 11 and directly opposite the brush 195, as shown in FIGS. 1 and 2. The cleaner brush 195 is partially enclosed in a housing 180. When the backer 160 moves into contact with one side of the photoreceptor belt 10, the imaging surface 11 of the belt 10 is urged into cleaning contact with the cleaner brush 195, as shown in FIG. 1. The direction of movement by the backer 160, into contact with the photoreceptor belt, is shown by arrow 12.

Referring now to FIG. 2, the backer 160 is retracted from the side of the photoreceptor belt 10, opposite the imaging surface 11. Thus releasing the imaging surface 11 of the photoreceptor belt 10 from cleaning contact (i.e. the brush rotatingly removing particles from the surface with it's fibers) with the cleaner brush 195. The direction of movement by the backer 160, away from contact with the photoreceptor belt 10, is shown by arrow 14. The photoreceptor 10 is supported by two back-up rollers 165, 175 on either side of the backer 160. The back-up rollers maintain the proper tension of the photoreceptor belt 10 as the backer 160 moves into and out of contact with the photoreceptor belt 10. The engagement (FIG. 1) and disengagement (FIG. 2) of the backer 160 and the cleaner brush 195 with opposite sides of the photoreceptor 10 occurs in the the non-imaging region of the photoreceptor 10 to maintain a high productivity level.

Another embodiment of the present invention is shown in FIGS. 3–6, where two retracting backers (i.e. non-rotatable or rotatable) are used to engage and disengage the cleaner brushes 190, 195. The retracting photoreceptive backers 160, 170, rather than the cleaner brushes 190, 195, significantly reduce the complexity of the cleaner drive, because no retraction motion of the cleaner is required. The cleaner brushes 190, 195 also have a larger mass than the photoreceptor backers 160, 170, which means that retracting the cleaner brushes 190, 195 would require more power and generate higher forces than the retraction mechanism of the present invention. The higher loads and more complex system result in a lower reliability for cleaner retraction when compared to photoreceptor backer retraction.

These difficulties can be demonstrated on a cleaner system which retracts the electrostatic brush cleaner housing separately from the photoreceptor. In such a cleaner system, a DC retraction motor is used to rotate two cam shafts, which retract the cleaner housings. A belt between the cam shafts maintains the retraction and engagement timing between the first cleaner housing and the second cleaner housing. A large cleaner housing surrounds two smaller cleaner housings to allow independent retraction of the two brushes by mounting pivot bearings and containing toner. In the present invention, the photoreceptor backers 160, 170 are retracted, allowing a single cleaner housing to be used and furthermore, pivot bearings and seals can be eliminated to reduce the cost of the cleaner. These cost reductions more than offset the cost associated with adding photoreceptor backer retraction to a photoreceptor belt module.

Furthermore, the effect of retracting photoreceptor backers on the steering of the photoreceptor belt 10 and on photoreceptor motion quality has been tested and analyzed. The analysis showed that the belt steering and motion quality disturbances caused by retracting the cleaner backers were small and within an acceptable motion quality tolerance, when tight tolerances were maintained on alignment of the moving backer with a high gain photoreceptor drive servo system.

Reference is now made to FIGS. 3–6 which show different positions of the backers 160, 170 during the cleaning operation of a dual electrostatic brush cleaner. In the image-on-image, multi-pass color development process, four layers of color toner (black, cyan, yellow and magenta) are developed onto the photoreceptor before transfer to paper. A separate cycle of the photoreceptor is required to accomplish the development of each color toner layer. To avoid disturbance of these images as the color toner layers are being developed, the cleaning elements must be disengaged from the photoreceptor surface until after the four toner layers have been developed and transferred to paper. After the toner image has been transferred to the paper the cleaning brushes 190, 195 are re-engaged to the photoreceptor to clean any residual toner which failed during transfer. In order to maintain a high productivity level, the cleaning elements should disengage and engage the photoreceptor within the space of the interdocument zones. This requires that the disengagement and engagement occur over fairly short time periods which depend on the length of the interdocument zone and on the photoreceptor process speed. For example, at photoreceptor speeds of 40 ppm (prints per minute) and 65 ppm the estimated time for engagement or disengagement of the brushes 190, 195 is approximately 130 milliseconds (msec) and 80 msec, respectively. Dual electrostatic brush cleaners provide two brush cleaners biased to different polarities to clean particles of different polarities.

Figure 3:
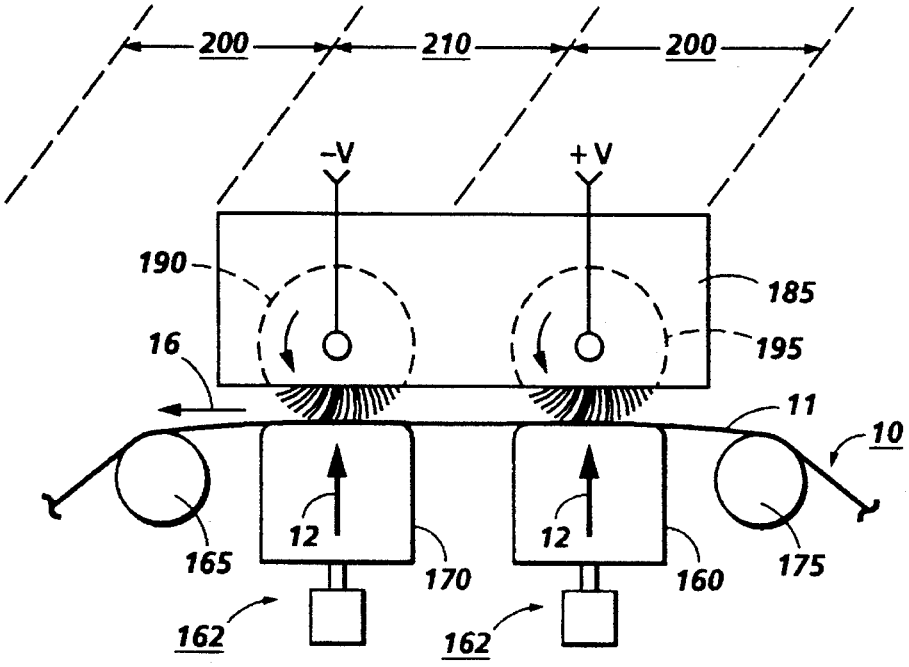
FIG. 3 is a schematic elevational view of a dual brush cleaner with both of the backers engaged.

In FIG. 3, both backers 160, 170 are shown in contact with the side of the photoreceptor belt 10 opposite the imaging surface 11. The backers 160, 170 are located directly opposite the cleaning brushes 190, 195, respectively, on the side of the photoreceptor belt opposing the cleaner brushes 190, 195. The backers 160, 170 move into contact with the photoreceptor belt 10 in the direction shown by arrows 12 causing the imaging surface 11 to make cleaning contact with the cleaning brushes 190, 195. The cleaning brushes 190, 195 are partially enclosed in a single housing 185. The backers 160, 170 are located between two back-up rolls 165, 175. These back-up rolls 165, 175 provide adequate tensioning for the photoreceptor belt 10 as the backers 160, 170 move into and out of contact with the photoreceptor 10. The backers 160, 170 are positioned such that the brush cleaners 190, 195 are in cleaning contact with the surface 11 (i.e. imaging and non-imaging regions) of the photoreceptor 10 after transfer of the particles to the paper occurs. The cleaner brushes 190, 195 engage and disengage the photoreceptor in the interdocument zone (i.e. non-imaging region) (not shown).

Figure 4:
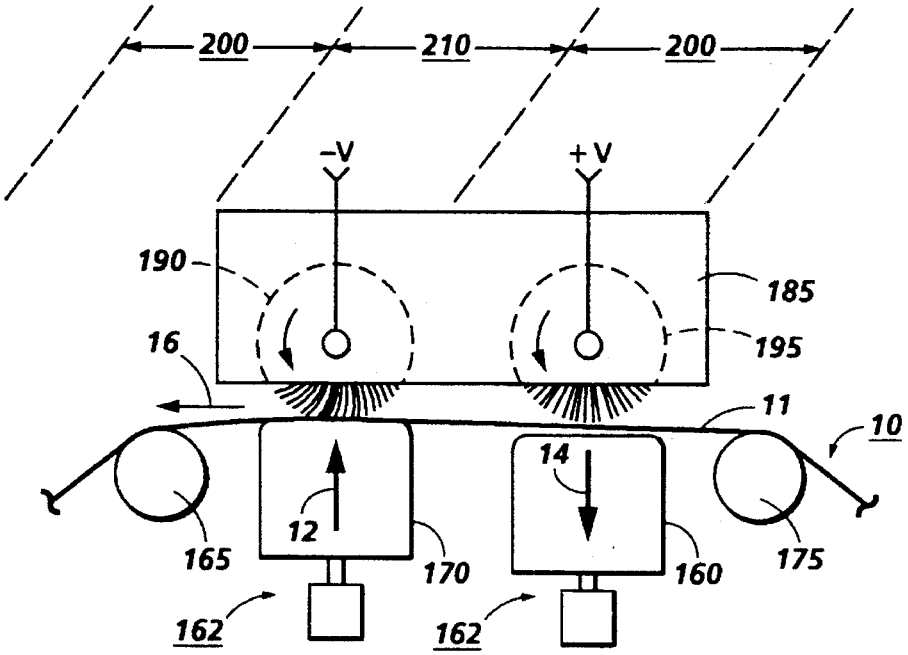
FIG. 4 is a schematic elevational view of a dual brush cleaner with the first backer retracted and the second backer engaged.
Figure 5:
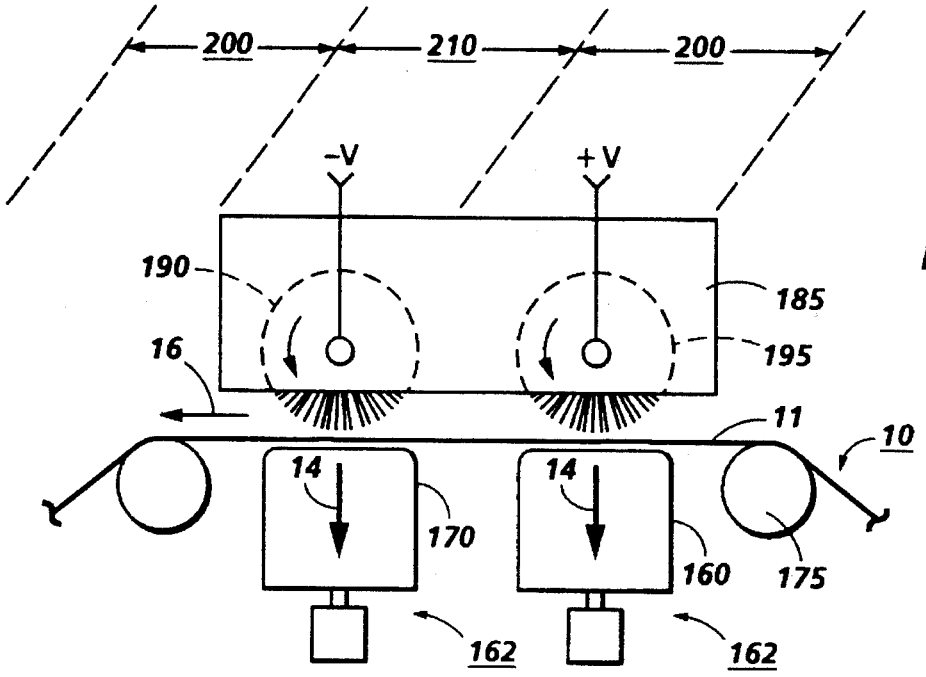
FIG. 5 is a schematic elevational view of both backers retracted from the dual brush cleaner.

After the photoreceptor 10 has completed a cleaning cycle past the cleaning brushes 190, 195 in the contact position shown in FIG. 3, the backers 160, 170 are removed from contact with the photoreceptor 10 to release the imaging surface 11 from cleaning contact with the cleaner brushes (see FIG. 5). However, depending on the length of the interdocument zone, the backers 160, 170 may need to be removed from contact independently of each other (see FIGS. 4 and 6), if the interdocument zone can not accommodate the mass of both brushes simultaneously.

In FIG. 4, the first backer 160, in the direction of motion of the photoreceptor 10, shown by arrow 16, is retracted away from the photoreceptor 10, in the direction shown by arrow 14, when the interdocument zone 200 reaches the first backer 160, after a completed cleaning cycle. The second backer 170 remains in contact with the photoreceptor 10 in the imaging region 210. As the photoreceptor 10 continues movement in the direction shown by arrow 16, the second backer 170 will be retracted as the interdocument zone 200 reaches the second backer 170. Thus, both backers 160, 170 are retracted from the photoreceptor 10, as shown in FIG. 5, as image on image, multi-pass development takes place.

Figure 6:
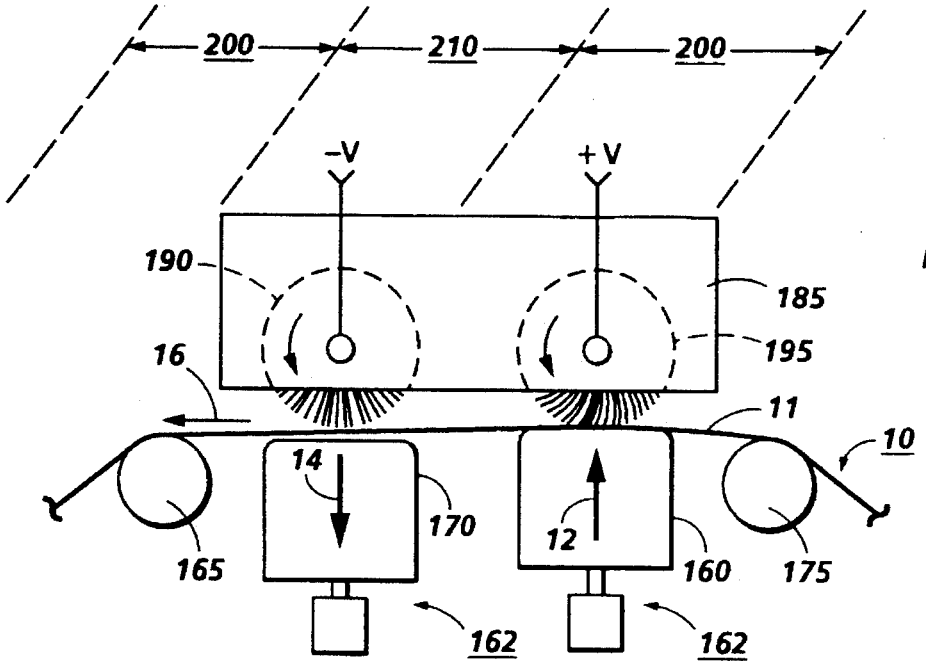
FIG. 6 is a schematic elevational view of a dual brush cleaner with the first backer engaged and the second backer retracted.

Reference is now made to FIG. 6, which shows the first backer 160 engaged and the second backer 170 retracted from the photoreceptor 10. After single pass transfer of the developed image, the residual toner particles are cleaned from the imaging surface 11. The first backer 160 moves into contact with the photoreceptor 10, shown by arrow 12, to move the imaging surface 11, of the photoreceptor 10, into contact with the cleaner brush 195 while the cleaner brush 195 is in the interdocument zone 200. As the interdocument zone passes by the first brush 195, in contact with the surface 11, the interdocument zone 200 approaches the second brush 190 which is out of contact with the surface. The second backer 170 then moves the photoreceptor 10 into contact with the second brush 190, as shown in FIG. 3, to clean the imaging surface. The aforementioned sequence of FIGS. 3–6 described above is then repeated.

In FIGS. 1–6, the cleaning devices are shown as (electrostatic) cleaner brushes. The cleaning devices, however, are not limited to electrostatic cleaning brushes. Other cleaning elements include magnetic and mechanical cleaning brushes, cleaning blades and cleaning webs.

In recapitulation, the present invention provides a method and apparatus for bringing the photoreceptor into and out of cleaning contact with the cleaning brushes using photoreceptor backers. The motion quality and belt steering concerns in using photoreceptor backers have been minimized. An advantage of moving the photoreceptor backers rather than the cleaning device, decreases the number of cleaning housings needed thus, reducing the cleaner cost.

It is therefore apparent, that there has been provided, in accordance with the present invention, a cleaner brush backer retraction apparatus that fully satisfies the aims and advantages herein before set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a surface after transfer of an image therefrom, comprising:

a cleaning device;

a non-rotating member supporting the surface, said member moving the surface between a first position remote from said cleaning device and a second position in contact with said cleaning device in response to the image having been transferred from the surface, said member including a backer and two backup rollers, said backer being located between said backup rollers; and an electrical means, operatively associated with said member, for moving the surface.

2. An apparatus as recited in claim 1, wherein the surface is interposed between said backer and said cleaning device.

3. An apparatus as recited in claim 2, wherein said backer moves between a position in contact with one side of the surface and a position spaced from the one side of the surface to move the surface between the first position and the second position.

4. An apparatus as recited in claim 3, wherein said cleaning device comprises a brush.

5. An apparatus as recited in claim 4, wherein said brush comprises an electrostatic brush.

6. An apparatus for removing particles from a surface after transfer of an image therefrom, comprising:

a cleaning device;

a non-rotating member supporting the surface, said member moving the surface along a path between a first position remote from said cleaning device and a second position in contact with said cleaning device in response to the image having been transferred from the surface, said member comprising at least two backers including a first backer adjacent to a second backer; and at least two backup rollers, said first backer and said second backer being located between said backup rollers.

7. An apparatus as recited in claim 6, wherein said cleaning device comprises a first brush and a second brush, said first brush located upstream from said second brush in a direction of motion of the surface.

8. An apparatus as recited in claim 7, wherein said first backer and said first brush being opposed from one another with the surface being interposed therebetween, and said second backer and said second brush being opposed from one another with the surface being interposed therebetween.

9. An apparatus as recited in claim 8, wherein the surface is interposed between said backers and said cleaning device.

10. An apparatus as recited in claim 9, wherein the surface comprises a non-imaging region and an imaging region.

11. An apparatus as recited in claim 10, wherein said backers move into and out of contact with one side of the surface in the non-imaging region of the surface.

12. An apparatus as recited in claim 11, wherein the movement of said backers enables movement of the surface between a plurality of positions including a first position, a second position, a third position and a fourth position.

13. An apparatus as recited in claim 12, wherein said first position comprises said first backer moving out of contact with one side of the surface in the non-imaging region urging said first brush out of contact with another side of the surface in the non-imaging region, the non-imaging region of the surface moves past said first brush to a position adjacent to said second brush, located downstream from the first brush in a direction of motion of the surface, said second backer moves out of contact with one side of the surface, in the non-imaging region, urging said second brush out of contact with another side of the surface, in the non-imaging region.

14. An apparatus as recited in claim 12, wherein said second position comprises said first backer moving into contact with one side of the surface in the non-imaging region urging said first brush into contact with another side of the surface in the non-imaging region, the non-imaging region of the surface moves past said first brush to the position adjacent said second brush, located downstream from the first brush in the direction of motion of the surface, said second backer moving out of contact with one side of the surface, in the non-imaging region, urging said second brush out of contact with another side of the surface, in the non-imaging region.

15. An apparatus as recited in claim 12, wherein said third position comprises said first backer moving into contact with one side of the surface in the non-imaging region urging said first brush into contact with another side of the surface in the non-imaging region, the non-imaging region of the surface moves past said first brush to a position adjacent to said second brush, located downstream from the first brush in the direction of motion of the surface, said second backer moving into contact with one side of the surface, in the non-imaging region, urging said second brush into contact with another side of the surface in the non-imaging region.

16. An apparatus as recited in claim 12, wherein said fourth position comprises said first backer moving out of contact with one side of the surface, in the non-imaging region, urging said first brush out of contact with another side of the surface, in the non-imaging region, the non-imaging region of the surface moves past said first brush to a position adjacent to said second brush, located downstream from the first brush in the direction of motion of the surface, said second backer moving into contact with one side of the surface, in the non-imaging region, urging said second brush into contact with another side of the surface, in the non-imaging region.

17. A method for cleaning particles from a surface having an imaging region and a non-imaging region, comprising:

transferring a developed image from the surface;

moving a non-rotating backer into contact with a side of the surface to urge the non-imaging region of the surface into contact with a cleaning device after said transferring step;

enabling the cleaning device to remove particles from the surface remaining thereon after transfer of the developed image; and spacing said backer from the surface to space said cleaning device from the surface.

18. The method of claim 17, wherein the moving step comprises the step of contacting the surface with said cleaning device comprising a brush.

19. The method of claim 18, wherein the spacing step comprises the step of moving said cleaning device away from the surface.

20. The method of claim 19, further comprising the step of moving the surface along a path.

21. A method for cleaning particles from a surface having an imaging region and a non-imaging region, comprising:

transferring a developed image from the surface;

moving a non-rotating backer into contact with a side of the surface, in the non-imaging region, to urge the surface into contact with a cleaning brush after said transferring step;

enabling the cleaning brush to remove particles from the surface remaining thereon after transfer of the developed image;

spacing said backer from the surface for moving said cleaning brush away from the surface as the surface moves along a path;

transferring a developed image from the surface having two non-rotating backers, including said backer and a second backer, adjacent to an opposite side of the surface from the developed image;

moving said backer and said second backer into contact, sequentially, with the opposite side of the surface, in the non-imaging region to urge the surface into contact with two cleaning brushes, including a first brush and a second brush, respectively, after transfer of the developed image from the surface, in the non-imaging region;

removing particles from the surface, remaining after transfer of the developed image, with said cleaning brushes in contact with the surface; and retracting said backer and said second backer, sequentially, away from contact with the surface, in the non-imaging region, to release said first brush and said second brush, respectively,from contact with the surface, in the non-imaging region.

* * * * *